US007360386B2

(12) United States Patent
Bair

(10) Patent No.: US 7,360,386 B2
(45) Date of Patent: Apr. 22, 2008

(54) SWEEP UNIT ASSEMBLY

(75) Inventor: Jerry P. Bair, Muskegon, MI (US)

(73) Assignee: Century, Inc., Traverse City, MI (US)

( * ) Notice: Subject to any disclaimer, the term of this patent is extended or adjusted under 35 U.S.C. 154(b) by 394 days.

(21) Appl. No.: 10/965,546

(22) Filed: Oct. 14, 2004

(65) Prior Publication Data

US 2005/0120767 A1 Jun. 9, 2005

Related U.S. Application Data

(60) Provisional application No. 60/511,010, filed on Oct. 14, 2003.

(51) Int. Cl.
*B21D 7/08* (2006.01)

(52) U.S. Cl. ..... 72/168; 72/307

(58) Field of Classification Search ..... 72/168, 72/306, 177, 181, 307
See application file for complete search history.

(56) References Cited

U.S. PATENT DOCUMENTS

| | | | | |
|---|---|---|---|---|
| 2,150,731 A | | 3/1939 | Smith | |
| 2,395,651 A | | 2/1946 | Anderson | 153/32 |
| 2,420,064 A | | 5/1947 | Boddy | |
| 2,480,826 A | | 9/1949 | Anderson | 153/2 |
| 2,851,080 A | | 9/1958 | Anderson | 153/2 |
| 2,935,115 A | | 5/1960 | Anderson | 153/32 |
| 2,954,066 A | | 9/1960 | Anderson | 153/32 |
| 2,960,140 A | | 11/1960 | Anderson | 153/32 |
| 3,889,513 A | | 6/1975 | Iwasaki et al. | 72/385 |
| 3,958,436 A | | 5/1976 | Anderson | 72/17 |
| 4,039,063 A | | 8/1977 | Knudson | 193/35 R |
| 4,367,641 A | * | 1/1983 | Mizutani | 72/65 |
| 4,391,116 A | | 7/1983 | Yogo | |

(Continued)

FOREIGN PATENT DOCUMENTS

GB 1482271 7/1994

OTHER PUBLICATIONS

PCT International Search Report and Written Opinion, International Application No. PCT/US04/33923; International Filing Date Oct. 14, 2004.

*Primary Examiner*—Daniel C Crane
(74) *Attorney, Agent, or Firm*—Howard & Howard Attorneys, P.C.

(57) ABSTRACT

The subject invention discloses a sweep unit assembly having a series of stations defining a path for an elongated article. A cradle is coupled to each of the stations. The stations are movable to introduce a first curve into the path and the article and each of the cradles are independently movable for introducing a second curve into the path and the article. A mount is included that supports at least one of the stations. The mount engages a base such that each of the stations are movably secured to the base and remain easily accessible for adjusting the stations and the cradles to impart various degrees of curvature into the path and the article. The sweep unit assembly is capable of imparting a curve into an elongated article formed of a metal and having a tensile strength greater than 80 KSI and a yield strength of 6 to 9 percent. The subject invention also discloses a method of adjusting the sweep unit assembly and a method of introducing a curve into the elongated article.

47 Claims, 12 Drawing Sheets

U.S. PATENT DOCUMENTS

| | | | | | |
|---|---|---|---|---|---|
| 4,530,226 | A | | 7/1985 | Granzow et al. | 72/171 |
| 4,608,849 | A | | 9/1986 | Brugman | 72/217 |
| 4,624,121 | A | * | 11/1986 | Kitsukawa et al. | 72/65 |
| 4,759,206 | A | | 7/1988 | Kaneko | 72/134 |
| 4,876,872 | A | | 10/1989 | Kaneko | 72/133 |
| 4,972,696 | A | | 11/1990 | Apps et al. | |
| 4,989,435 | A | | 2/1991 | Kaneko | 72/133 |
| 5,036,688 | A | | 8/1991 | Gillean | 72/7 |
| 5,086,635 | A | | 2/1992 | Creaser et al. | 72/176 |
| 5,161,401 | A | | 11/1992 | Lisec | 72/307 |
| 5,395,036 | A | | 3/1995 | Sturrus | 228/146 |
| 5,454,504 | A | | 10/1995 | Sturrus | 228/17 |
| 5,592,844 | A | | 1/1997 | Baumgartner | 72/133 |
| 5,884,517 | A | * | 3/1999 | Yogo | 72/166 |
| 5,934,544 | A | | 8/1999 | Lee et al. | 228/146 |
| 6,378,339 | B1 | | 4/2002 | Zalesak et al. | 65/104 |
| 2003/0038489 | A1 | | 2/2003 | Renzzulla et al. | 293/102 |

* cited by examiner

SWEEP UNIT ASSEMBLY

CROSS-REFERENCE TO RELATED APPLICATIONS

The subject patent application claims priority to and all the benefits of U.S. Provisional Patent Application Ser. No. 60/511,010, which was filed on Oct. 14, 2003.

BACKGROUND OF THE INVENTION

1. Field of the Invention

The subject invention relates to a sweep unit assembly for use with a roll former.

2. Description of Related Art

Manufacturing apparatuses using a roll former are well known in the prior art and include a series of paired roll dies for progressively deforming and shaping a continuous strip of stock material. For example, roll formers are commonly used to form articles such as metal window or door frames. Each pair of roll dies has a slightly different configuration with a last pair of roll dies having a complementary configuration matching the final desired shape of the article, i.e., the shape of the metal window or door frame. The high speed and continuous nature of roll forming lends itself to economic production of large volume of parts. Hence, roll forming is a desirable manufacturing technique due to the virtually infinite lengths of material and the significant cost reductions as compared to stamping techniques.

In certain applications, it is desirable to have a curved profile imported into the shaped article, i.e., in roof bows and headers for vehicles. Hence, the shaped stock article must be bent or curved along one or more axes as the finished article emerges from the roll former. In order to implement the desired bend or curve, a sweep unit assembly is often utilized. Most prior art sweep unit assemblies are only capable of curving the material in a single direction. An example of a prior art sweep unit assembly of this type is shown in U.S. Pat. No. 4,530,226.

The prior art has also developed sweep unit assemblies that are capable of simultaneously curving the article in two directions to form a compound curve in the article. These sweep unit assemblies, however, are time consuming and difficult to adjust, often fail to impart the desired curves into the article, and are extremely limited in their application.

Further, for both the single and compound curve sweep unit assemblies of the prior art, these units can only curve material having limited tensile and yield strengths. The prior art sweep unit assemblies commonly impart a curve into an article formed of a material having a tensile strength of 40 KSI to 132 KSI and a yield strength of 15 to 20 percent. These strength limitations prevent certain components from being curved. As such, these components cannot be formed on a sweep unit assembly and must be formed by a less efficient stamping technique.

Accordingly, it would be desirable to develop a sweep unit assembly capable of imparting curves into articles formed of materials of greater strengths. Further, it would be desirable to impart a compound curve into virtually any article while avoiding the deficiencies of the prior art assemblies.

SUMMARY OF THE INVENTION AND ADVANTAGES

The subject invention includes a sweep unit assembly for introducing at least one curve into an elongated article. The sweep unit assembly comprises a base and a series of stations defining a path for the article with the stations being movable relative to the base to introduce a first curve into the path and the article. Each of the stations include a first support and a second support with a stabilizing bar interconnecting the first and second supports. A cradle is coupled to each of the stations between the first and second supports with each of the cradles independently movable relative to each of the stations in a direction transverse to the movement of the stations for introducing a second curve into the path and the article. Each of the stations further include a mount supporting the first and second supports and engaging the base such that each of the stations are movably secured to the base and remain easily accessible for adjusting the stations and the cradles to impart various degrees of curvature into the path and the article.

The subject invention also encompasses a manufacturing apparatus having a sweep unit assembly in combination with a sweep block disposed within each of the cradles. An elongated article passes through each of the sweep blocks along the first and second directions of the path to impart at least one curve into the article. The elongated article is formed of a metal having a tensile strength greater than 132 KSI and a yield strength of 6 to 9 percent.

The subject invention also includes a method of adjusting the sweep unit assembly relative to a fixed plane. The method comprises the steps of: adjusting each station in the first direction relative to the fixed plane; progressively positioning each station along the first direction; adjusting each cradle in the second direction relative to the fixed plane; progressively positioning each cradle along the second direction; and the steps of adjusting and progressively positioning each station being further defined as pivotally adjusting each station relative to a fixed pivot point on the fixed plane and arcuately positioning one station relative to an adjacent station along the first direction for introducing at least one curve into the path.

The subject invention further includes a method of introducing a curve into the elongated article. This method comprises the steps of: progressively positioning each station along the first direction to introduce the first curve into the path; progressively positioning each cradle about the second direction to introduce the second curve into the path; passing the elongated article through each of the stations and cradles along the first and second directions to impart a compound curve into the article; and automatically pivoting the cradle through a predetermined angle in response to the article passing through the stations and cradles.

Accordingly, the subject invention provides an improved sweep unit assembly that can impart a desired curve into various articles that were previously incapable of being swept. Further, the sweep unit assembly of the subject invention can be easily set up, i.e., adjusted and re-secured, to accommodate a variety of single and compound curves for the various articles. Also, the subject invention includes a variety of unique methods of adjusting the sweep unit assembly and imparting a curve into the article that overcome various deficiencies in the prior art assemblies.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
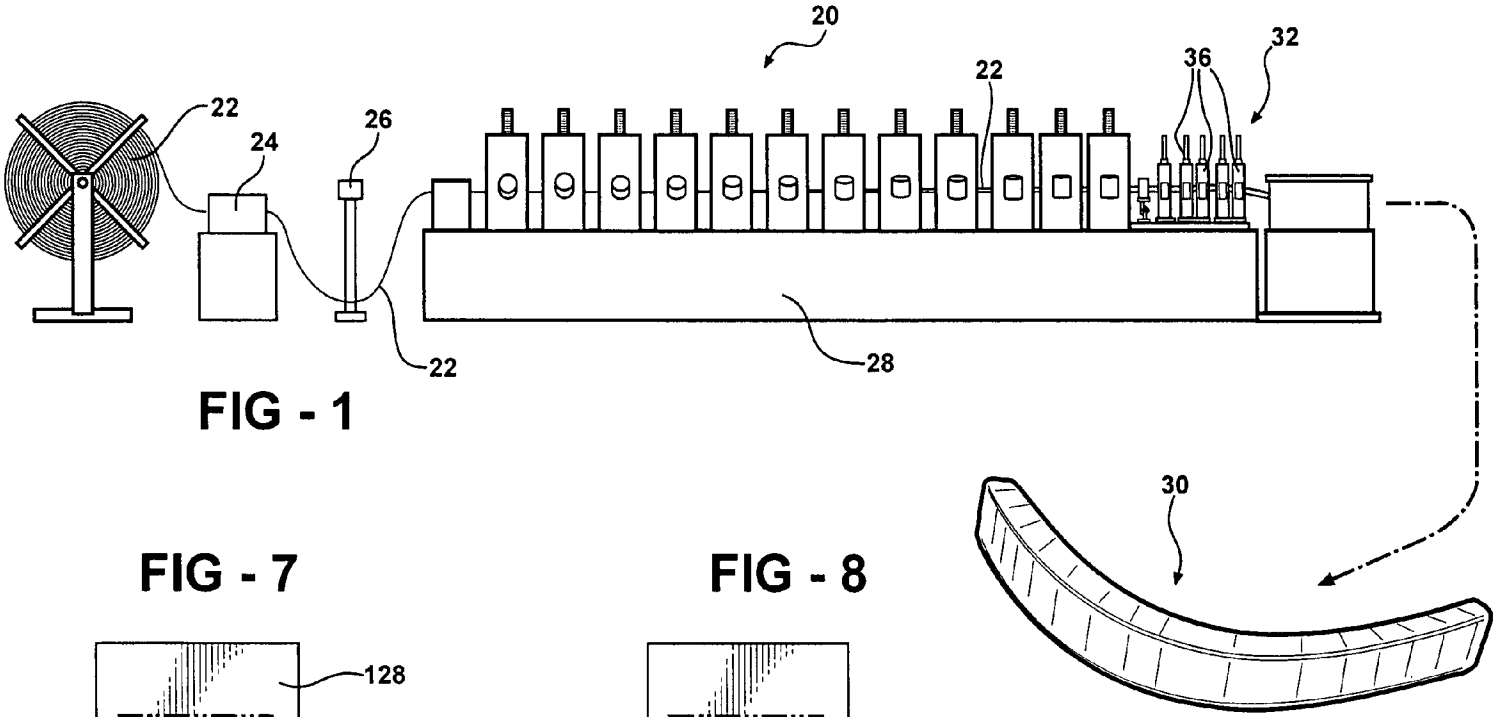
FIG. 1 is a schematic side view of a manufacturing apparatus incorporating the subject invention.

Referring to the Figures, wherein like numerals indicate like or corresponding parts throughout the several views, a manufacturing apparatus is generally shown at 20 in FIG. 1. The manufacturing apparatus 20 includes a reel of coiled material 22 that feeds into a straightener 24. The material 22 then passes through a loop control 26 and into a roll former 28. The roll former 28 includes a series of paired roll dies for progressively deforming and shaping the material into an elongated article 30. Each pair of roll dies has a slightly different configuration with the last pair of roll dies having a complementary configuration matching the final desired shape of the article 30. Manufacturing apparatuses 20 and roll formers 28 of this type are well known in the art and will therefore not be discussed in any greater detail.

In certain applications, it is desirable to have a curved profile formed in the article 30 after the article 30 exists the roll former 28. As discussed in the background section, sweep unit assemblies are typically employed to impart a curve into the article 30. The sweep unit assemblies of the prior art, however, have a number of deficiencies. In order to overcome these deficiencies the subject invention discloses an improved sweep unit assembly, which is generally shown at 32. After the article 30 exists the sweep unit assembly 32, the article 30 is cut to a desired length. As is discussed in greater detail below, the sweep unit assembly 32 may impart a single or compound curve into the finished article 30.

Referring to FIGS. 2-9, a preferred embodiment of the sweep unit assembly 32 is shown in greater detail. As best shown in FIGS. 2-5, the sweep unit assembly 32 includes a base 34 and a series of stations 36 movably mounted to the base 34. The base 34, in turn, includes an adjustment plate 38 movably mounted to a fixed plate 40. The fixed plate 40 can be fixedly secured to a support platform, such as an extension of the roll former 28 (shown in FIG. 1). A number of gibs 42 secure the adjustment plate 38 to the fixed plate 40. In particular, the gibs 42 are slip fit to the adjustment plate 38 to allow the adjustment plate 38 to slide or move relative to the fixed plate 40.

A base adjustment device 44 is coupled between the adjustment plate 38 and the fixed plate 40 to selectively move the adjustment plate 38 relative to the fixed plate 40. The base adjustment device 44 includes an adjustment block 46 mounted to the adjustment plate 38 and a pull block 48 mounted to the fixed plate 40. An adjustment nut 50 is rotatably disposed within the pull block 48. A pull screw 52 threadingly engages the adjustment nut 50 and interconnects the adjustment block 46 with the pull block 48 such that winding of the adjustment nut 50 rotates the pull screw 52 and slidably moves the adjustment plate 38 relative to the fixed plate 40. Preferably, the adjustment plate 38 can move 1½ inches in each direction relative to the fixed plate 40.

Each of the stations 36 includes a first support 54 and a second support 56 with each of the supports 54, 56 including a top and a bottom. A stabilizing bar 58 interconnects the tops of the first 54 and second 56 supports for each station 36. Each of the supports 54, 56 also include an integral slot 60 disposed between the top and bottom.

The stations 36 define a path for the article 30 and at least one of the stations 36 is adjustable relative to an adjacent station 36 for moving relative to the base 34 to define a first direction of the path. Preferably, the stations 36 introduce a first curve into the path and the article 30. It should be appreciated that each station 36 includes the same major components and are substantially identical. As such, during much of the subsequent discussion, only one of the stations 36 will be specifically addressed.

Each of the stations 36 further include a mount 62 supporting the first 54 and second 56 supports and engaging the base 34. The mount 62 allows for each of the stations 36 to be being movably secured to the base 34 and remaining easily accessible such that the stations 36 can be easily adjusted to impart various degrees of curvature into the path and the article 30. Preferably, the mount 62 includes a mounting plate 64 bolted to the base 34 and coupled to each of the supports 54, 56. Further, the mount 62 preferably includes a bottom bar 66 bolted to the supports 54, 56 and coupled to the mounting plate 64. The bottom bar 66 interconnects the bottoms of the first 54 and second 56 supports for each station 36. As shown best in FIG. 3, the supports 54, 56 each have a U-shaped notch for accepting the bottom bar 66. It should be appreciated that the supports 54, 56 may be mounted to the bottom bar 66 in any suitable manner.

Each bottom bar 66 is slidably coupled to the mounting plate 64 through first 68 and second 70 slotted keepers. The first 68 and second 70 keepers are fixedly mounted to the mounting plate 64 and each include a slot (not numbered) for receiving the bottom bars 66. In particular, the slots align with the bottom bars 66 of the stations 36 and provide a slip fit between the keepers 68, 70 and bottom bar 66. The first keeper 68 is preferably larger than the second keeper 70 and also includes a threaded bore (not numbered).

Figure 3:
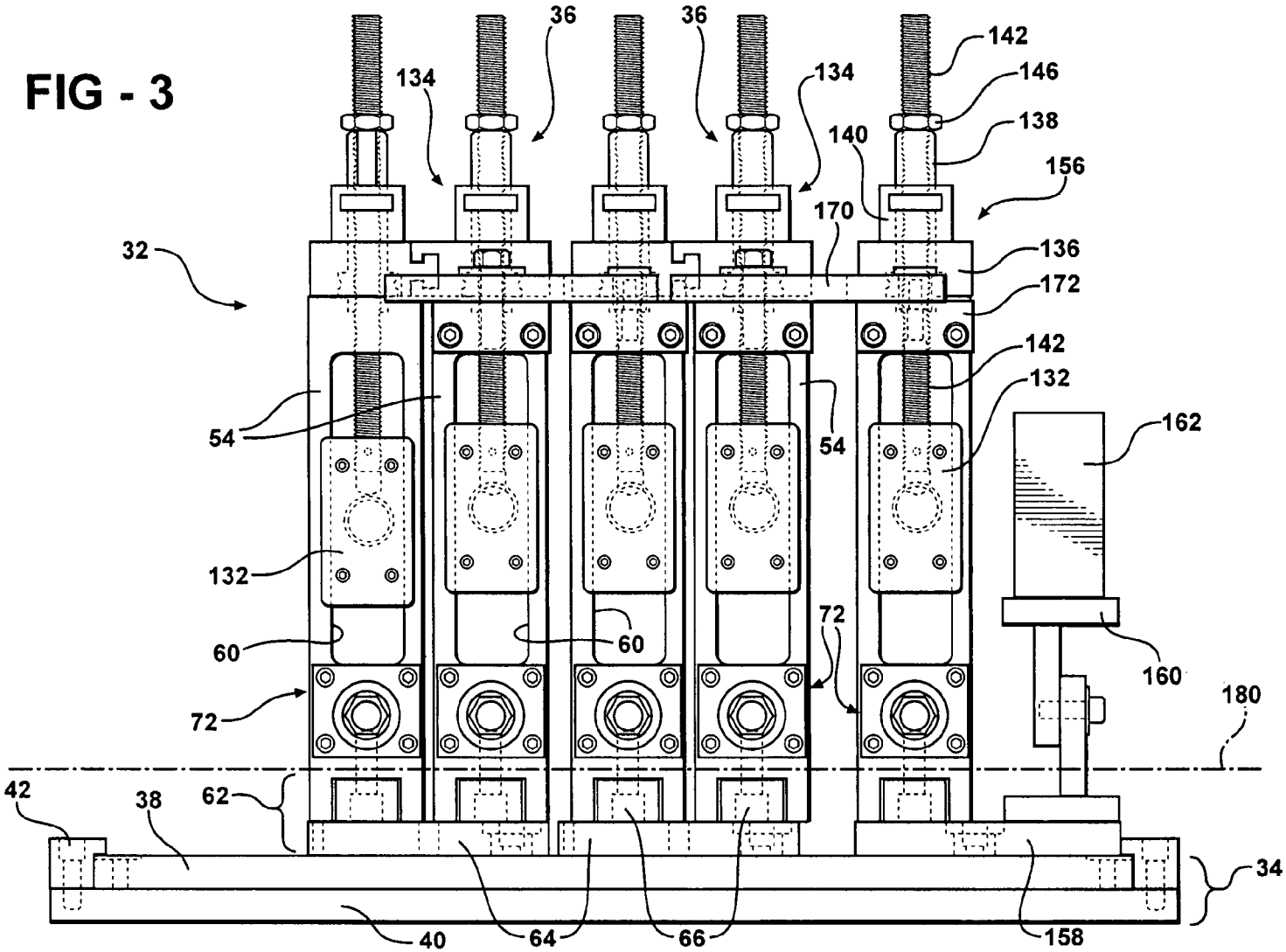
FIG. 3 is a side view of the sweep unit assembly.

A station adjustment device 72 is mounted to one of the first 54 and second 56 supports and is coupled to the mounting plate 64. The station adjustment device 72 laterally adjusts a position of the station 36 relative to the mounting plate 64. Preferably, the station adjustment device 72 is mounted to each of the first supports 54 of the series of stations 36. Specifically, the station adjustment device 72 includes a retainer 74 for housing and supporting an adjustment nut 76. A counter 108 is mounted about the adjustment nut 76 to monitor any rotational movement of the nut 76. A screw 80 is rotatably secured to the bore of the first keeper 68 by any suitable means and threadingly engages the adjustment nut 76. Hence, the screw 80 operatively couples the station 36 to the first keeper 68 and the mounting plate 64. Rotation of the adjustment nut 76 imparts rotational movement of the screw 80 to laterally move the station 36 relative to the mounting plate 64 and first keeper 68. As best shown in FIG. 3, each of the station adjustment devices 72 are centered relative to an associated first support 54. Preferably, the screw 80 of the station adjustment device 72 includes calibrated threads. The counter 78 can therefore provide an accurate indication of an amount of adjustment. In other words, it is desired that the screw 80 and the pitch of the threads of the screw 80 be calibrated to provide exact and logical measurements on the counter 78. It should be appreciated that the screw 80 could be disposed in either the first 54 or second 56 support without deviating from the scope of the invention. A jam nut 82 is disposed on the screw 80 for locking the screw 80 against the adjustment nut 76 in a desired position.

Figure 2:
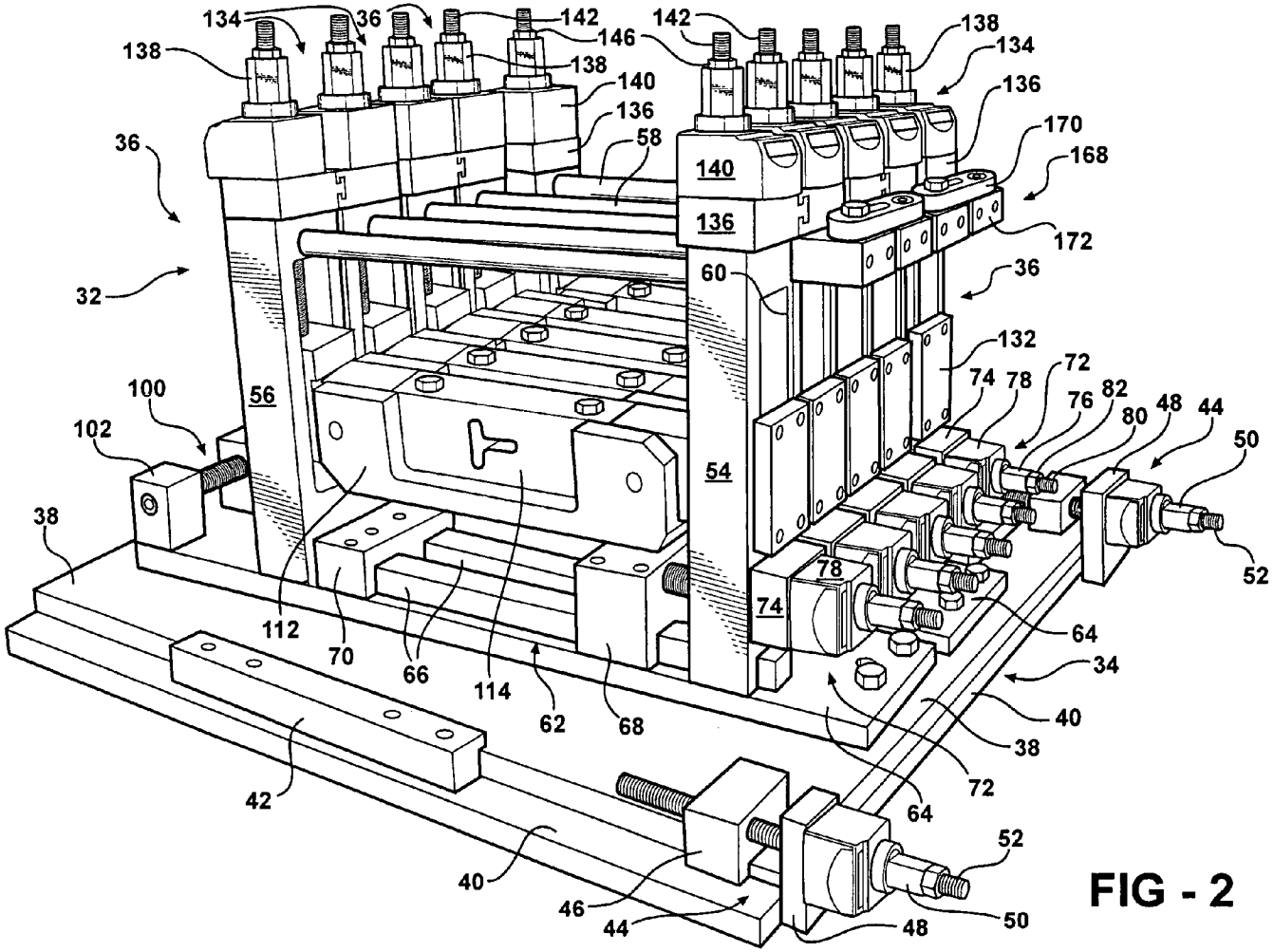
FIG. 2 is a perspective view of a sweep unit assembly in accordance with the subject invention.
Figure 4:
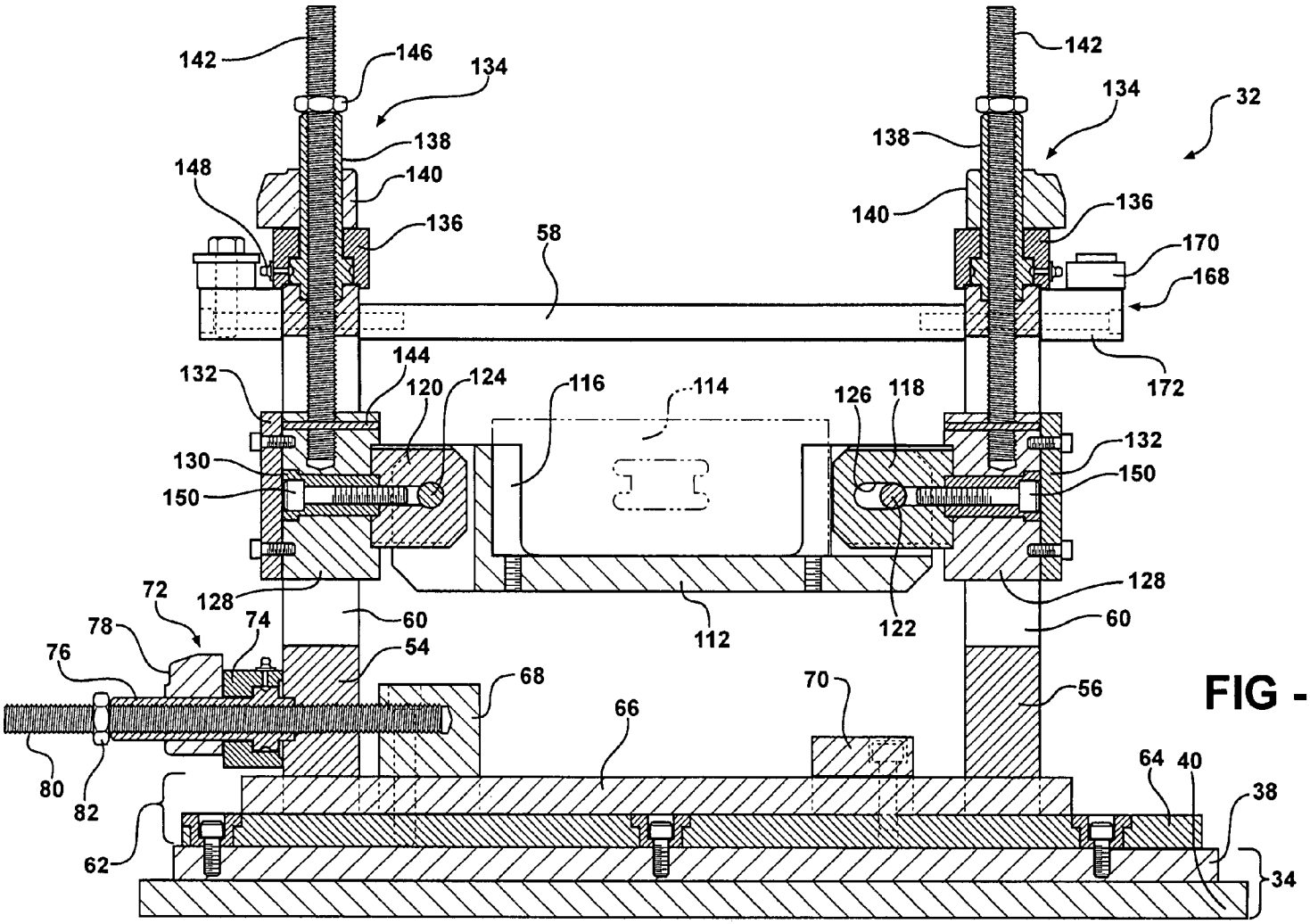
FIG. 4 is a cross-sectional front view of the sweep unit assembly.
Figure 5:
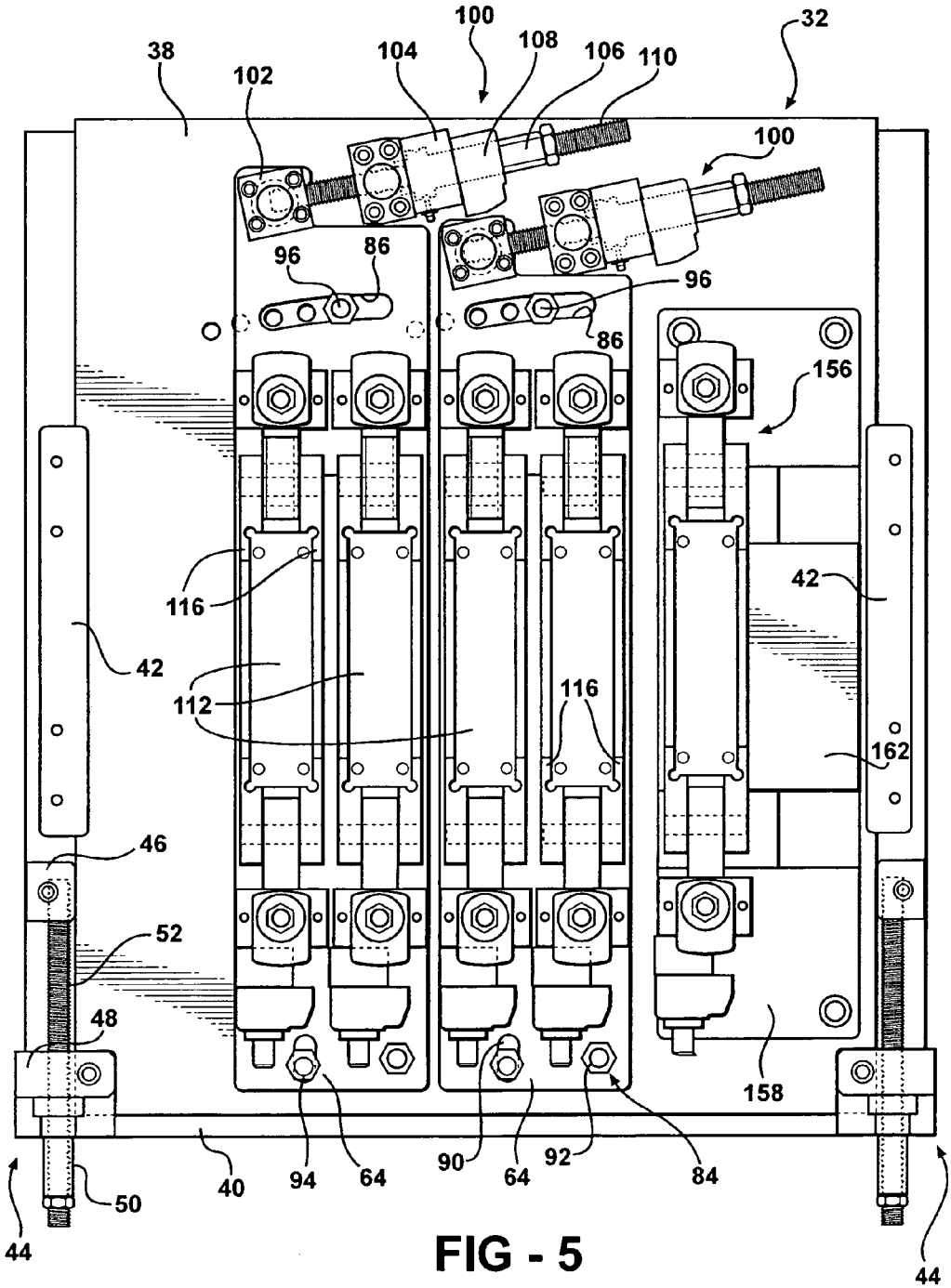
FIG. 5 is a top view of the sweep unit assembly.
Figure 6:
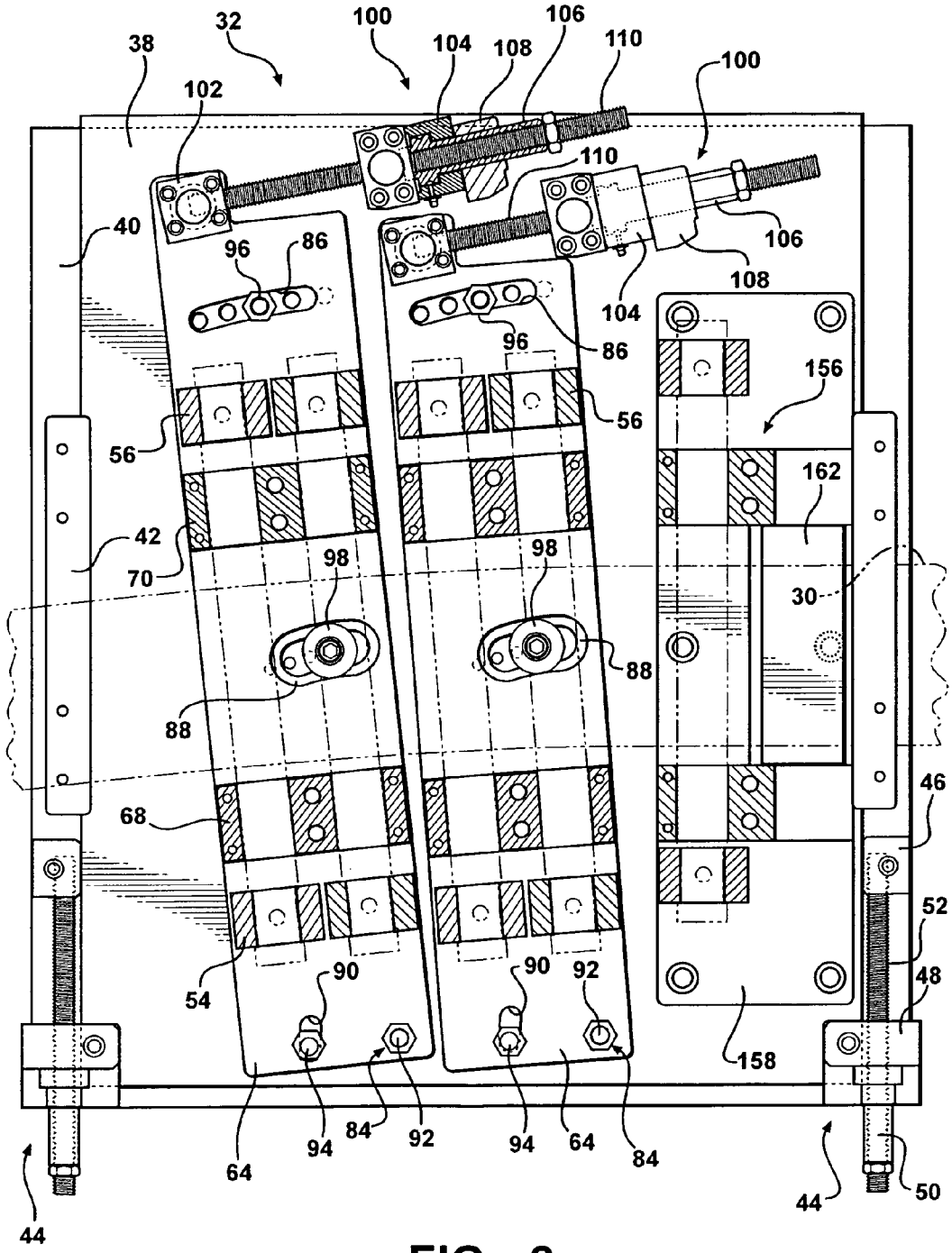
FIG. 6 is a partially cross-sectional top view of the sweep unit assembly.
Figure 9:
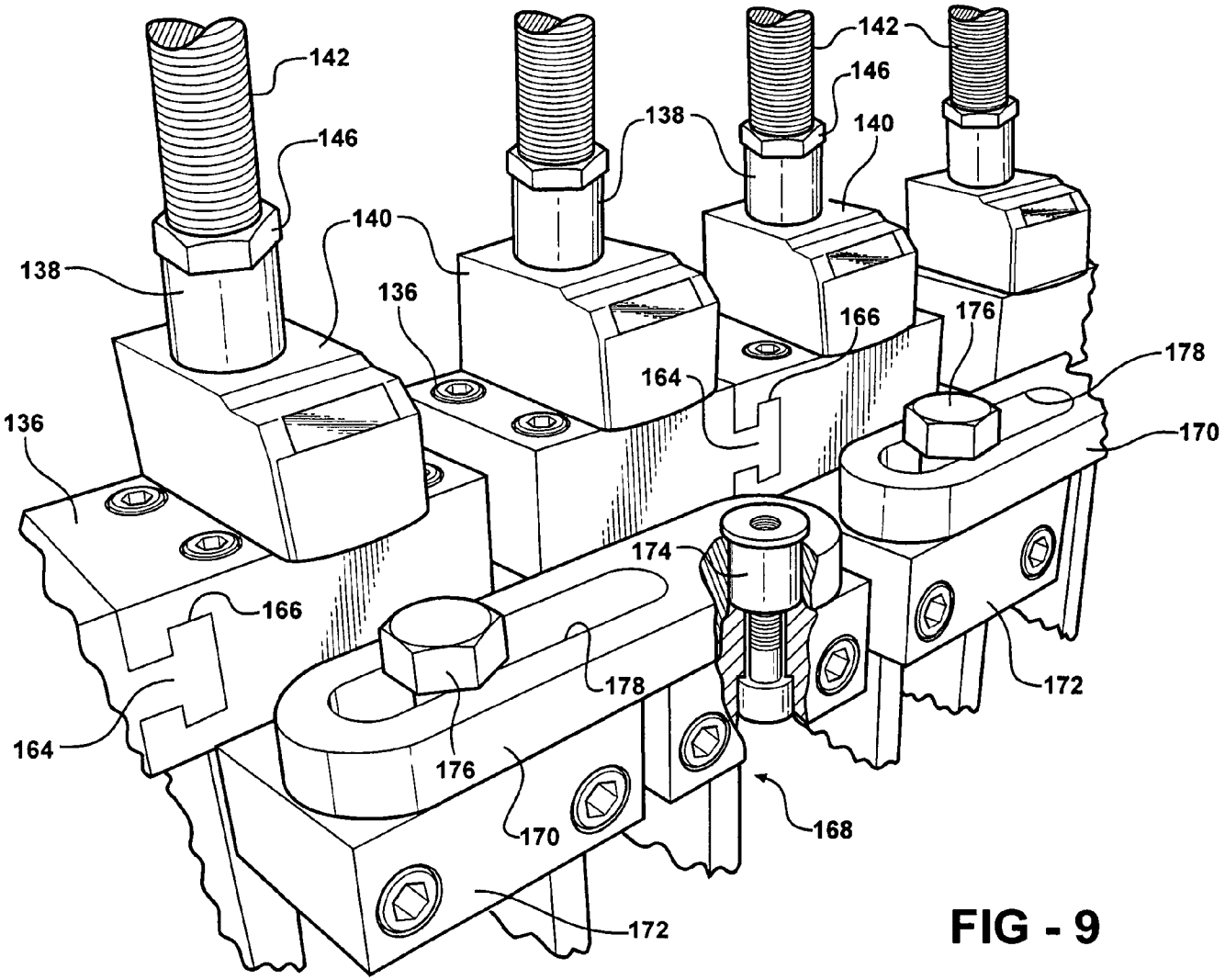
FIG. 9 is an enlarged perspective view of locking devices for the sweep unit assembly.

In the embodiment of FIGS. 2-9 and as best shown in FIGS. 2 and 5-6, the mounting plate 64 is pivotally mounted to the base 34 about a fixed pivot point 84. It should be appreciated that the mounting plate 64 may be secured to the base 34 in any suitable manner. The mounting plate 64 includes an arcuate adjustment slot 86 and an arcuate bearing slot 88. An arcuate slot 90 is disposed on an opposing side of the mounting plate 64 adjacent the pivot point 84. A pivot bolt 92 mounts the mounting plate 64 to the base 34 at the pivot point 84. Another bolt 94 passes through the arcuate slot 90 to also mount 62 the mounting plate 64 to the base 34. Further, an adjustment bolt 96 mounts the mounting plate 64 to the base 34 through the adjustment slot 86. A series of threaded apertures are disposed within the mounting plate 64 to provide a series of mounting points for the adjustment bolt 96. As best shown in FIG. 6, a bearing member 98 mounts the mounting plate 64 to the base 34 through the bearing slot 88. Preferably, the bearing member 98 is relatively large and the bearing slot 88 has a substantially bean shaped configuration. In the most preferred embodiment, each mounting plate 64 supports a pair of adjacent stations 36. Hence, as shown in FIG. 6, a pair of the stations 36 may be pivotally moved on a single mounting plate 64 relative to an adjacent pair of stations 36.

A mounting plate adjustment device 100 is coupled to the mounting plate 64 to adjust a position of the mounting plate 64 and the stations 36 relative to the base 34. In particular, the mounting plate adjustment device 100 includes a plate block 102 secured to the mounting plate 64 and a retainer 104 secured to the adjustment plate 38 of the base 34. An adjustment nut 106 is housed and supported by the retainer 104. A counter 108 is mounted about the adjustment nut 106 to monitor any rotational movement of the nut 106. A screw 110 is rotatably secured to the plate block 102 by any suitable means and threadingly engages the adjustment nut 106. Hence, the screw 110 operatively couples the mounting plate 64 to the base 34. Rotation of the adjustment nut 106 imparts rotational movement of the screw 110 to laterally move the mounting plate 64 relative to the adjustment plate 38 of the base 34. The screw 110 preferably has calibrated threads. Hence, the counter 108 can provide an accurate indication of an amount of adjustment. In other words, it is desired that the screw 110 and the pitch of the threads of the screw 110 be calibrated to provide exact and logical measurements on the counter 108.

As best shown in FIGS. 2, 4, and 5, the sweep unit assembly 32 also includes a cradle 112 coupled to each of the stations 36 between the first 54 and second 56 supports. Each of the cradles 112 are independently movable relative to each of the stations 36 such that at least one of the cradles 112 is adjustable relative to an adjacent cradle 112 to define a second direction of the path. In particular, the cradles 112 are independently movable relative to each of the stations 36 in a direction substantially transverse to the movement of the stations 36 for introducing a second curve into the path and the article 30. As such, the sweep unit assembly 32 is capable of introducing a compound curve into the elongated article 30.

A sweep block 114 is disposed within each of the cradles 112. The sweep blocks 114 may be of any suitable configuration and include a passageway corresponding to the cross-sectional configuration of the article 30. FIGS. 2 and 4 schematically illustrate two different cross-sectional configurations. The elongated article 30 passes through each of the sweep blocks 114 along the first and second directions of the path to impart at least one curve into the article 30. In other words, the sweep blocks 114 act as the bearing surface for the article 30 during the operation of the sweep unit assembly 32. In one contemplated embodiment, the first and second directions may be identical for imparting a single curve into the path and the article 30. Alternatively, the first and second directions may be different for imparting a compound curve into the path and the article 30.

Figure 12:
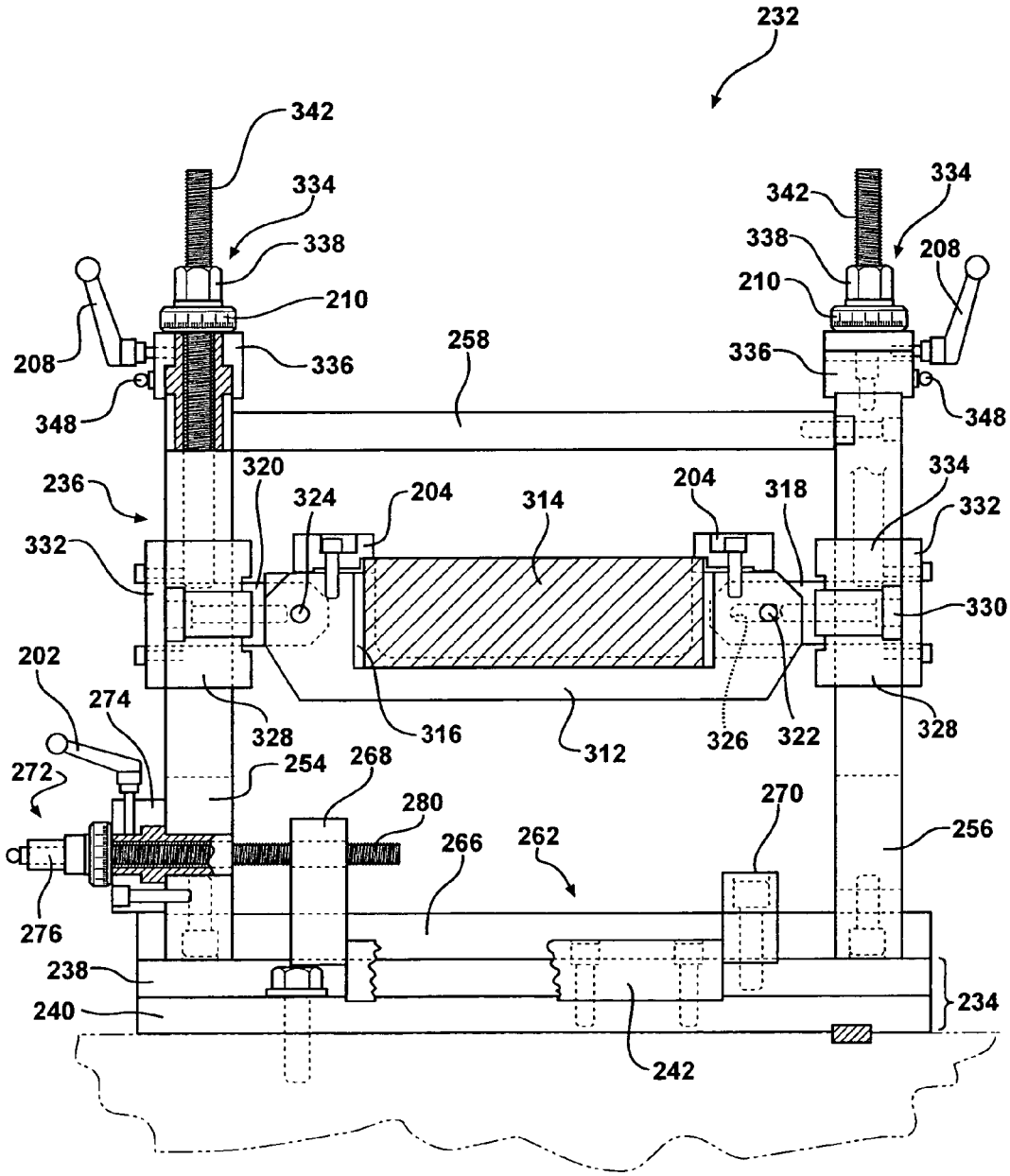
FIG. 12 is a partially cross-sectional front view of the sweep unit assembly of FIG. 10.

The cradle 112 has a substantially U-shaped configuration for supporting the sweep block 114 and at least partially encapsulating the sweep block 114. In particular, the cradle 112 includes a pair of flanges 116 that flank the sweep block 114 on both sides. The sweep block 114 may be secured to the cradle 112 in any suitable manner, such as a series of bolts as shown. Alternatively as shown in FIG. 12, a pair of gibs 204 may be disposed on the cradle 112 to retain the sweep blocks 114 in position.

As best shown in FIG. 4, a first yoke 118 is pivotally connected to one end of the cradle 112 and a second yoke 120 is pivotally connected to the other end of the cradle 112. The first yoke 118 includes a first retainer pin 122 to facilitate the movement of the first yoke 118 relative to one end of the cradle 112. The second yoke 120 similarly includes a second retainer pin 124 to facilitate the movement of the second yoke 120 relative to an opposing end of the cradle 112. The second retainer pin 124 also slides within a slot 126 formed in the second yoke 120 to ensure that the cradle 112 can smoothly pivot at both ends independently of each other within the station 36. In other words, the pin/slot arrangement in the second yoke 120 prevents the cradle 112 from binding during vertical movement.

The first yoke 118 extends through the slot 60 in the first support 54 and the second yoke 120 extends through the slot 60 in the second support 56. An adjustment slide 128 is mounted to each end of the cradles 112 and is slidably disposed within the slots 60 of the stations 36. In particular, the first 118 and second 120 yokes are mounted to associated adjustment slides 128 within the slots 60. Preferably, each of the adjustment slides 128 are mounted to the first 118 and second 120 yokes through a retaining spool 130. It should be appreciated that the adjustment slides 128 could be mounted to the yokes 118, 120 in any suitable manner. A slide cap 132 is mounted to each of the adjustment slides 128 on an opposing side of the slots 60. The slide caps 132 abut an outer surface of the supports 54, 56 and slidably ride along the supports 54, 56 during adjustment. Preferably, the adjustment slides 128 are precision fit within the slots 60 to allow adequate sliding but to also prevent undesirable lash between the cradle 112 and the supports 54, 56. The adjustment slides 128, slide caps 132, and yokes 118, 120 allow each end of the cradle 112 to move vertically upward and downward as desired without binding. This upward and downward movement allows the cradle 112 to be angled relative to the station 36 as shown in Figure.

A cradle adjustment device 134 is coupled to the adjustment slides 128 for adjusting a position of the cradle 112 relative to the supports 54, 56 within the slots 60. Each of the cradle adjustment devices 134 include a retainer 136 mounted to the top of the supports 54, 56 and define a cavity. An adjustment nut 138 is rotatably housed and supported within the cavity. A counter 140 is mounted about the adjustment nut 138 to monitor any rotational movement of the nut 138. A screw 142 is rotatably secured to each of the adjustment slides 128 by any suitable means, such as through a roll pin 144, and threadingly engages the adjustment nut 138. Hence, the screw 142 operatively couples the adjustment slides 128 and cradle 112 to the supports 54, 56. Rotation of the adjustment nut 138 imparts rotational movement of the screw 142 to vertically move the adjustment slides 128 and corresponding end of the cradle 112 relative to the supports 54, 56. The screw 142 preferably has calibrated threads. Hence, the counter 140 can provide an accurate indication of an amount of adjustment. In other words, it is desired that the screw 142 and the pitch of the threads of the screw 142 be calibrated to provide exact and logical measurements on the counter 140. A jam nut 146 is provided for each of the screws 142 to retain the screws 142 in a desired position. A grease fitting 148 is likewise provided for the screws 142.

Figure 8:
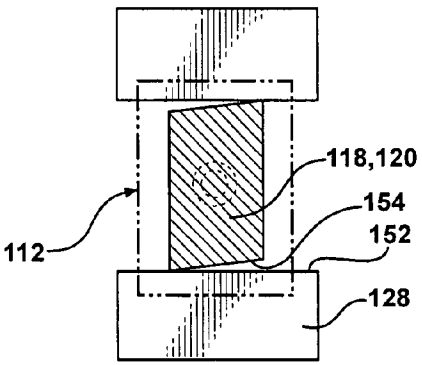
FIG. 8 is a side view of the cradle in an angled position.
Figure 7:
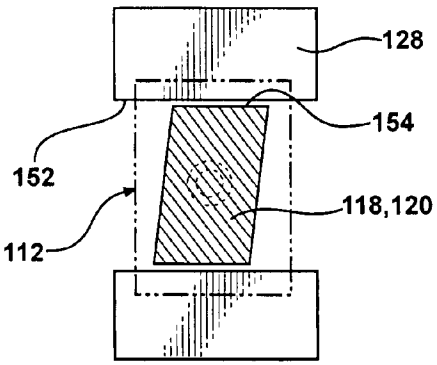
FIG. 7 is a side view of a cradle in a longitudinal position.

As best shown in FIGS. 4 and 7-8, the cradle 112 also includes a pair of transverse pivot pins 150 coupling the cradle 112 to the supports 54, 56 and defining a cradle axis transverse to both of the movements of the stations 36 and the cradles 112. The pivot pins 150 automatically pivot the cradle 112 through a predetermined angle in response to the article 30 passing through the stations 36 and cradles 112. In other words, the cradles 112 are allowed to freely pivot during operation but this movement is limited to the predetermined angle. The free movement is designed to account for various variances, such as variances in steel thickness. The movement is limited in order to maintain adequate integrity within the sweep unit assembly 32. Preferably, each of the pivot pins 150 extend through the adjustment slides 128 and into the cradle 112. Even more preferably, the pivot pins 150 couple the adjustment slides 128 to the yokes 118, 120.

The cradle 112 also includes hard stops defining the predetermined angle. In particular, each of the adjustment slides 128 includes an inner abutment surface 152. Each end of the cradle 112 includes exterior walls 154 angled relative to the abutment surface 152 by the predetermined angle such that the angled walls 154 engage the abutment surface 152 during the pivoting of the cradle 112 to define the hard stops. Preferably, the angled exterior walls 154 defining the predetermined angle are disposed on the yokes 118, 120. Through experimentation, it has been found that the predetermined angle may range from 2 degrees up to 10 degrees. In the most preferred embodiment, the predetermined angle is 6 degrees.

As best shown in FIGS. 1, 3, and 5 an initial station 156 is coupled to the adjustment plate 38 of the base 34 relative to the movable series of stations 36. Specifically, the initial station 156 is mounted to a fixed mounting plate 158. Otherwise, the initial station 156 includes the same components as the stations 36 of the movable series of stations 36. In particular, the initial station 156 includes first 54 and second 56 supports a stabilizing bar 58, a bottom bar 66, a cradle 112, as well as both station 72 and cradle 134 adjustment devices. As also shown in FIGS. 3 and 5, a platform 160 is coupled to the base 34 adjacent the initial station 156 for supporting an entry sweep block 162. In particular, the platform 160 is mounted to the same fixed mounting plate 158. The entry sweep block 162 is designed to be placed adjacent the roll former 28 to provide a smooth transition between the roll former 28 and the sweep unit assembly 32.

Returning to FIGS. 2-4 and 9, the retainers 136 for the cradle adjustment devices 134 preferably have a common configuration that includes a common locking device. In particular, the locking device includes a T-shaped locking finger 164 disposed on one of the supports 54, 56 and a complementary shaped cavity 166 disposed within an adjacent support 54, 56. The cavity 166 receives the T-shaped locking finger 164 and interconnects adjacent supports 54, 56 and stations 36. As mentioned above, there are preferably a pair of stations 36 on a single mounting plate 64. The locking device preferably interconnects each pair of stations 36. The sides of the retainers 136 at the ends of the mounting plate 64 have the T-shaped locking finger 164 and cavities 166 removed. It should be appreciated that the locking device may have any suitable configuration so long as the stations 36 are adequately retained.

The stations 36 also include a secondary locking device 168 for interconnecting each pair of stations 36. In particular, the secondary locking device 168 includes a locking arm 170 interconnecting each adjacent pairs of stations 36. Mounting blocks 172 are secured to an outboard surface of the stations 36 to be interconnected. As illustrated, the mounting blocks 172 are secured to the supports 54, 56 inbetween the slots 60 and the retainers 136. The locking arm 170 is bolted to each mounting block 172 to provide adequate locking engagement between the pairs of stations 36 on adjacent mounting plates 64. In particular, the locking arm 170 is mounted to one of the mounting blocks 172 through a spool 174 and to the other mounting block 172 through a bolt 176. The locking arm 170 has an elongated slot 178 wherein the bolt 176 can slide within the slot 178 during the adjustment of the stations 36 relative to each other.

The above described design of the sweep unit assembly 32 is particularly robust and therefore can impart curves into articles 30 that have traditionally only been stamped. In particular, the sweep unit assembly 32 of the subject invention can impart at least one curve into an elongated article 30 formed of a metal having a tensile strength greater than 132 KSI and a yield strength of 6 to 9 percent. The preferred range includes the metal having a tensile strength of from greater than 132 KSI to 220 KSI. The most preferred range includes the metal having a tensile strength of from greater than 132 KSI to 140 KSI. One preferred selection of metals includes high-strength steel (HSLA) having a tensile strength of 60 KSI to 100 KSI. Alternatively, the metal can be further defined as ultra high-strength steel having a tensile strength of 101 KSI to 220 KSI.

The metal can be selected from the group of ferrous metal, nonferrous metal, hot-rolled metal, cold-rolled metal, polished metal, plated metal, pre-painted metal, and combinations thereof. Further, the metal can be selected from the group of aluminum, steel, steel alloys, titanium, martensite, high strength steel (HSLA), ultra-high strength steel, and the like.

Having described the manufacturing apparatus 20, the sweep unit assembly 32, and the material of the article 30 in detail, various unique methods will now be discussed. In particular, the subject invention includes a method of adjusting the sweep unit assembly 32 relative to a fixed plane 180.

The method comprises the steps of adjusting each station 36 in a first direction relative to the fixed plane 180. First, each mounting plate adjustment device 100 is actuated, either manually or electronically, to move each mounting plate 64 and corresponding station 36. Then, each station 36 is then progressively positioned along the first direction. Preferably, a first curve is introduced into the path as the stations 36 are progressively positioned along the first direction. Even more preferably, the steps of adjusting and progressively positioning each station 36 are further defined as pivotally adjusting each station 36 relative to the fixed pivot point 84 on the fixed plane 180 and arcuately positioning one station 36 relative to an adjacent station 36 along the first direction for introducing at least one curve into the path. This pivotal adjustment adjusts the stations through twenty degrees.

Each cradle 112 is adjusted in a second direction relative to the fixed plane 180. First, each cradle adjustment device 134 is actuated, either manually or electronically, to move each cradle 112 relative to each station 36. Similarly, each cradle 112 is progressively positioned along the second direction. Preferably, a second curve is introduced into the path as the cradle 112 is progressively positioned along the second direction.

In one embodiment, the first and second directions are identical for introducing a single curve into the path. Alternatively, the first and second directions are different for introducing a compound curve into the path.

In addition, each station 36 may be laterally adjusted relative to the mounting plate 64. Each station adjustment device 72 is actuated, either manually or electronically, to laterally slide each station 36 relative to an associated mounting plate 64. Each station 36 can be staggered to assist in imparting the single or compound curves into the article 30. Further, the adjustment plate 38 may be slidably moved relative to the fixed plate 40. The base adjustment device 44 would be actuated to move the adjustment plate 38 relative to the fixed plate 40.

The subject invention also includes a particular method of introducing a curve into the elongated article 30. This method comprising the steps of progressively positioning each station 36 along the first direction to introduce the first curve into the path. Each cradle 112 is then progressively positioned about the second direction to introduce the second curve into the path. The elongated article 30 is passed through each of the stations 36 and cradles 112 along the first and second directions to impart the compound curve into the article 30. The method also includes the step of automatically pivoting the cradle 112 through the predetermined angle in response to the article 30 passing through the stations 36 and cradles 112.

The step of pivoting the cradle 112 is further defined as pivoting the cradle 112 about the cradle axis until the cradle 112 abuts the station 36 thereby defining the hard stop and the predetermined angle. Specifically, the cradle 112 pivots until the exterior walls 154 of the yokes 118, 120 engage the inner abutment surfaces 152 of the adjustment slides 128. Preferably, the cradle 112 pivots through a predetermined angle of 2 degrees to 10 degrees. Even more preferably, the cradle 112 pivots through a predetermined angle of 6 degrees.

Turning now to FIGS. 10-14, an alternative embodiment of the sweep unit assembly is generally shown at 232, wherein reference numerals increased by 200 indicate like or corresponding parts with the sweep unit assembly 32 of FIGS. 2-9. One significant modification of this alternative sweep unit assembly 232 is the elimination of the mounting plate 64 such that the stations 236 are slidably mounted directly to the base 234 to move laterally relative to the base 234. This design is in contradistinction from the embodiment of FIGS. 2-9, where the mounting plate 64 was provided to also allow the stations 36 to move pivotally relative to the base 34. Many other aspects are similar and all features of this alternative embodiment shown in FIGS. 10-14 are now discussed in greater detail.

Figure 11:
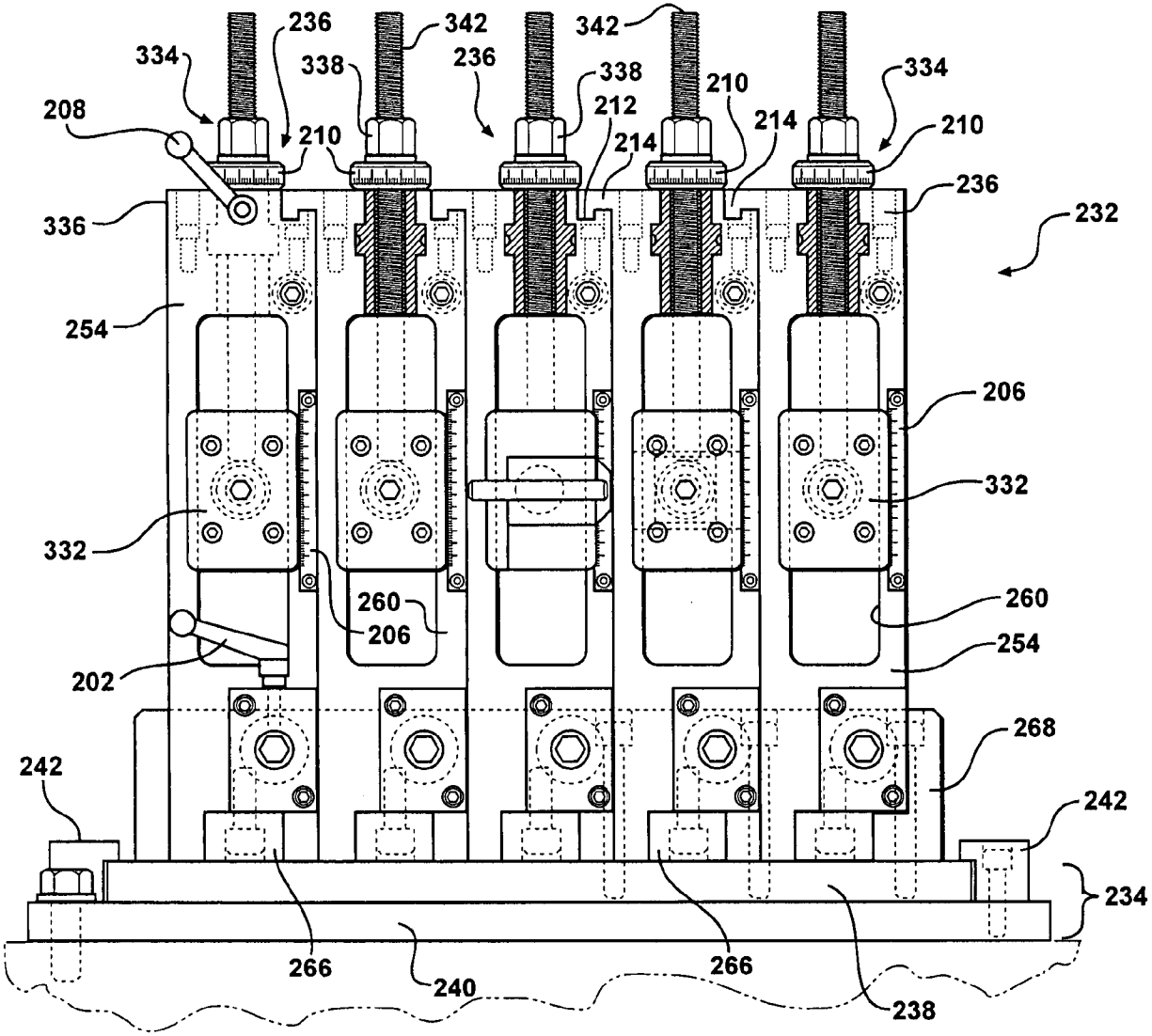
FIG. 11 is a side view of the sweep unit assembly of FIG. 10.

The sweep unit assembly 232 of this embodiment includes the base 234 having an adjustment plate 238 slidably supported on a fixed plate 240. As shown in FIG. 11, the adjustment plate 238 can be secured to the fixed plate 240 through a number of gibs 242. The gibs 242 are slip fit to the adjustment plate 238 to allow the adjustment plate 238 to slide or move relative to the fixed plate 240 in a sideways direction transverse to the sweep unit assembly 232.

Figure 10:
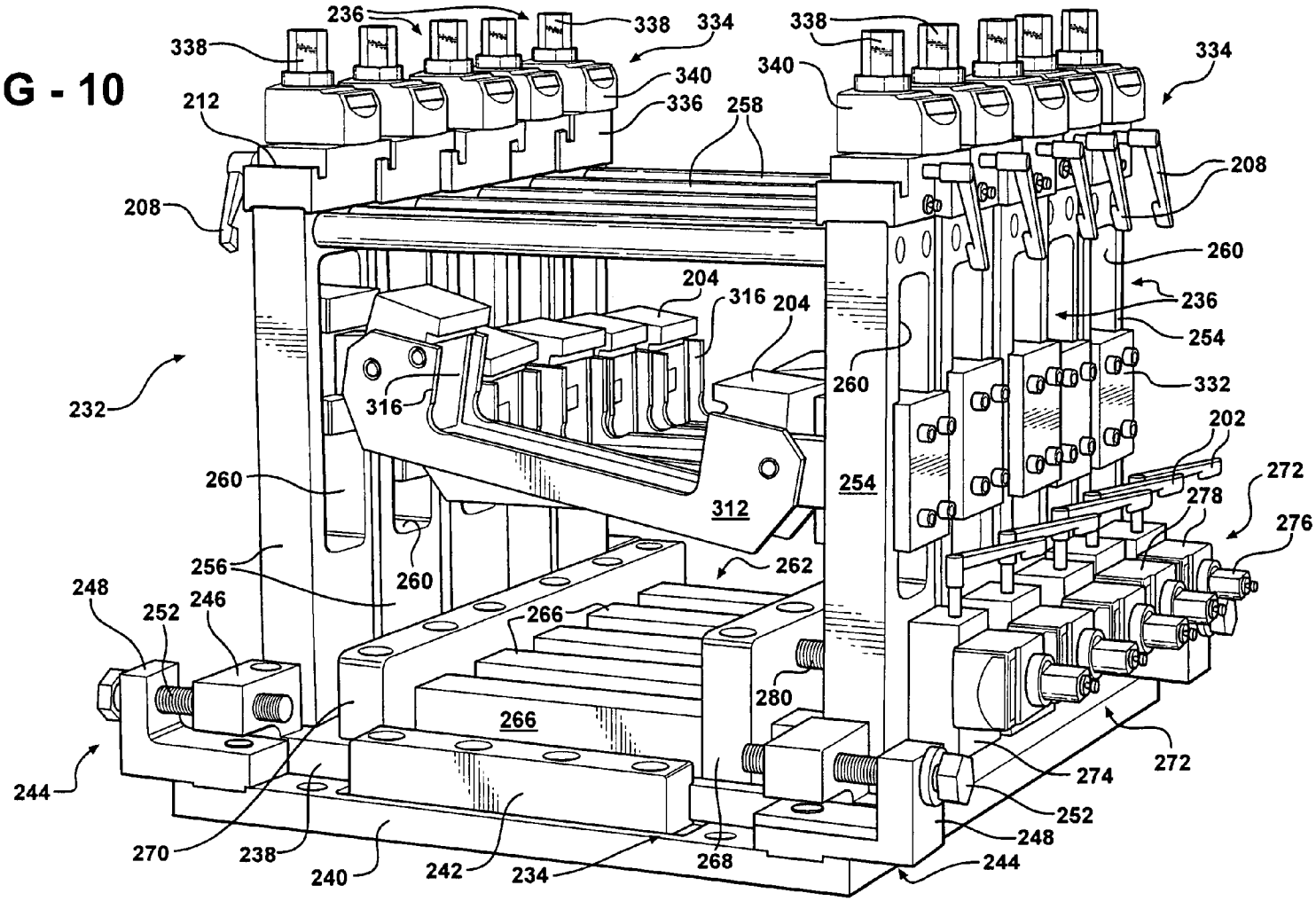
FIG. 10 is a perspective view of an alternative embodiment of the sweep unit assembly.
Figure 13:
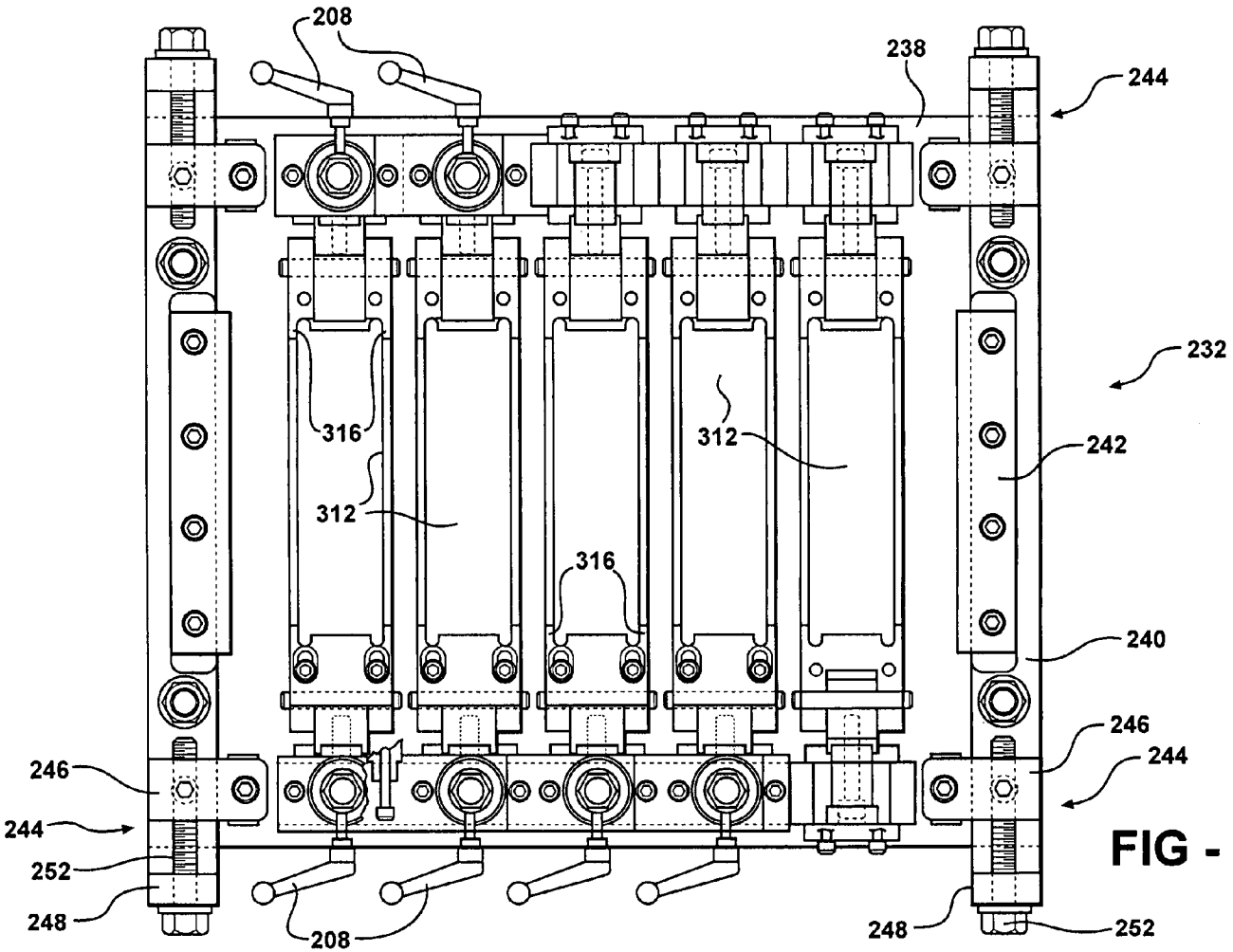
FIG. 13 is a top view of the sweep unit assembly of FIG. 10.
Figure 14:
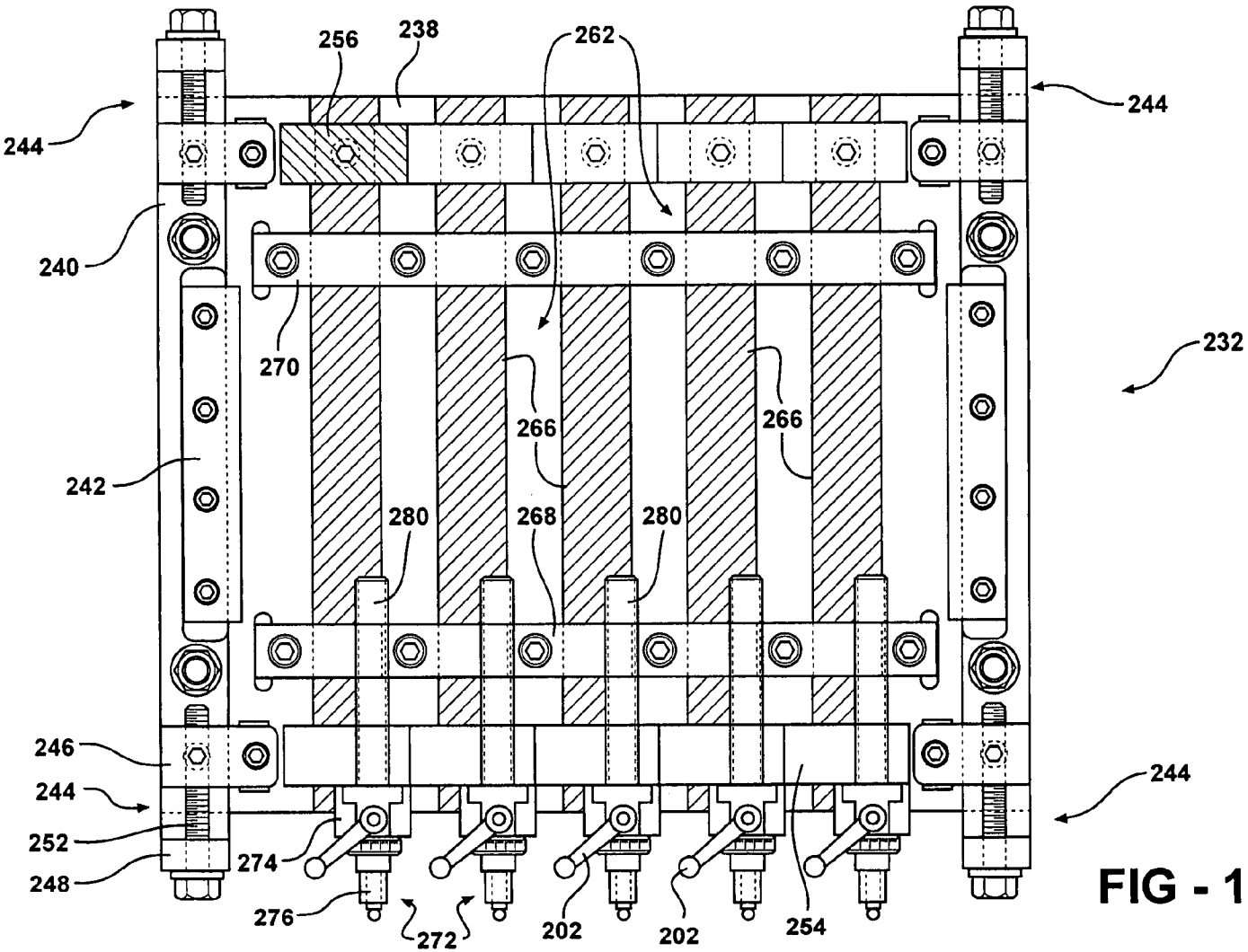
FIG. 14 is a partially cross-sectional top view of the sweep unit assembly of FIG. 10.

As best shown in FIGS. 10, 13, and 14, a base adjustment device 244 is coupled between the adjustment plate 238 and the fixed plate 240 to selectively move the adjustment plate 238 relative to the fixed plate 240. The base adjustment device 244 includes an adjustment block 246 mounted to the adjustment plate 238 and a pull block 248 mounted to the fixed plate 240. A pull screw 252 interconnects the adjustment block 246 with the pull block 248 such that winding of the pull screw 252 slidably moves the adjustment plate 238 relative to the fixed plate 240. The pull screw 252, adjustment block 246, and pull block 248 are sized to preferably provide 1½ inches of sideways adjustment in each direction.

Referring back to FIGS. 10-13, a series of stations 236 are individually supported on the adjustment plate 238. Each of the stations 236 includes a first support 254 and a second support 256 with each of the supports 254, 256 including a top and a bottom. A stabilizing bar 258 interconnects the tops of the first 254 and second supports 256 for each station 236. Each of the supports 245, 256 also include an integral slot 260 disposed between the top and bottom.

The stations 236 define a path for an article and at least one of the stations 236 is adjustable relative to an adjacent station 236 for moving relative to the base 234 to define a first direction of the path. Preferably, the stations 236 introduce a first curve into the path and the article. It should be appreciated that each station 236 includes the same major components and are substantially identical.

Each of the stations 236 further include a mount 262 supporting the first 254 and second 256 supports and engaging the base 234. The mount 262 provides for each of the stations 236 being movably secured to the base 234 and remaining easily accessible such that the stations 236 can be easily adjusted to impart various degrees of curvature into the path and the article. Preferably, the mount 262 is further defined as a bottom bar 266 bolted to each of the supports 254, 256 and coupled to the base 234. In particular, the bottom bar 266 is slidably secured to the base 234 to move laterally relative to the base 234. In the embodiment illustrated, the bottom bar 266 is directly supported on the adjustment plate 238. The bottom bar 266 interconnects the bottoms of the first 254 and second 256 supports for each station 236. As shown best in FIG. 11, the supports 245, 256 each have a U-shaped notch for accepting the bottom bar 266. It should be appreciated that the supports 254, 256 may be mounted to the bottom bar 266 in any suitable manner. Each bottom bar 266 is slidably secured to the adjustment plate 238 through first 268 and second 270 slotted keepers to provide the lateral movement of the stations 236.

The first 268 and second 270 keepers are fixedly mounted to the adjustment plate 238 and each include a plurality of slots (not numbered). The slots align with the bottom bars 266 of the stations 236 and provide a slip fit between the keepers 268, 270 and the bottom bar 266. The first keeper 268 is preferably larger than the second keeper 270 and also includes a plurality of threaded bores (not numbered) for coupling each of the first supports 254 of the stations 236 as is discussed in greater detail below.

A station adjustment device 272 is mounted to one of the supports 254, 256 and is coupled to the base 234 to laterally adjust the station 236 relative to the base 234. The station adjustment device 272 includes a retainer 274 and an adjustment nut 276. A lateral adjustment screw 280 is rotatably disposed in the first support 254 by the adjustment nut 276. The screw 280 also threadingly engages one of the bores of the first keeper 268 to operatively couple the station 236 to the first keeper 268 and the adjustment plate 238. As best shown in FIG. 11, the lateral adjustment screw 280 is off-set from the first support 254 because of packaging constraints. It should be appreciated that the lateral adjustment screw 280 could be disposed in either the first 254 or the second 256 support and in any suitable location. As shown in FIG. 10, a counter 278 may be mounted to the retainer 274 over the adjustment nut 276 to provide a visual indicator of the position of the station 236. Alternatively, as shown in FIGS. 11 and 12, a dial 210 can be mounted to the adjustment nut 276 to provide a similar visual indicator of the position of the station 236. It is desired that the type of lateral adjustment screw 280 and the pitch of the threads of the screw 280 be calibrated to provide exact and logical measurements on the counter 278 or dial 210. As such, a user can easily determine the amount of adjustment for each of the stations 236. A lateral locking handle 202 is provided to lock the adjustment nut 276, lateral adjustment screw 280, and station 236 in a particular position. A grease fitting 348 is also provided.

During a lateral adjustment operation of the station 236, the lateral locking handle 202 is released and the adjustment nut 276 is either manually or electrically, through an electric motor (not shown), turned to rotate the screw 280 and slide the station 236 relative to the adjustment plate 238. For example, the station 236 could adjust up to 1½ inches in each direction. Once the desired position is obtained, the lateral locking handle 202 is actuated to secure the new position of the station 236. The lateral adjustment of the station 236 imparts a lateral curve, in either direction, in the article passing through the sweep unit assembly 232.

Turning now to FIGS. 10, 12, and 13, a cradle 312 is coupled to each of the stations 236 between the first 254 and second 256 supports. Each of the cradles 312 are independently movable relative to each of the stations 236 such that at least one of the cradles 312 is adjustable relative to an adjacent cradle 112 to define a second direction of the path. In particular, the cradles 312 are independently movable relative to each of the stations 236 in a direction substantially transverse to the movement of the stations 236 for introducing a second curve into the path and the article. As such, the sweep unit assembly 232 is capable of introducing a compound curve into the elongated article.

A sweep block 314 is disposed within each of the cradles 312. The sweep blocks 162, 314 may be of any suitable configuration and include a passageway corresponding to the cross-sectional configuration of the article. In one contemplated embodiment, the first and second directions may be identical for imparting a single curve into the path and the article. Alternatively, the first and second directions may be different for imparting a compound curve into the path and the article.

The cradle 312 has a substantially U-shaped configuration for supporting the sweep block 314 and at least partially encapsulating the sweep block 314. In particular, the cradle 312 includes a pair of flanges 316 that flank the sweep block 314 on both sides. The sweep block 314 may be secured to the cradle 312 in any suitable manner, such as a pair of gibs 204.

A first yoke 318 is pivotally connected to one end of the cradle 312 and a second yoke 320 is pivotally connected to the other end of the cradle 312. The first yoke 318 includes a first retainer pin 322 to facilitate the pivotal movement of the first yoke 318 relative to one end of the cradle 312. The second yoke 320 similarly includes a second retainer pin 324 to facilitate the pivotal movement of the second yoke 320 relative to an opposing end of the cradle 312. The second retainer pin 324 also slides within a slot 326 formed in the second yoke 320 to ensure that the cradle 312 can smoothly pivot at both ends independently of each other within the station 236. In other words, the pin/slot arrangement in the second yoke 320 prevents the cradle 312 from binding during pivotal movement.

The first yoke 318 extends through the slot 260 in the first support 254 and the second yoke 320 extends through the slot 260 in the second support 256. The first 318 and second 320 yokes are mounted to adjustment slides 328 within the slots 260. Preferably, each of the adjustment slides 328 are mounted to the first 318 and second 320 yokes through a retaining spool 330. It should be appreciated that the adjustment slides 328 could be mounted to the yokes 318, 320 in any suitable manner. A slide cap 332 is mounted to each of the adjustment slides 328 on an opposing side of the slots 260. The slide caps 332 abut an outer surface of the supports 254, 256 and slidably ride along the supports 254, 256 during adjustment. Preferably, the adjustment slides 328 are precision fit within the slots 260 to allow adequate sliding but to also prevent undesirable rocking movement of the cradle 312. The adjustment slides 328, slide caps 332, and yokes 318, 320 allow each end of the cradle 312 to move vertically upward and downward as desired without binding. This upward and downward movement allows the cradle 312 to be angled relative to the station 236. As best shown in FIG. 11, a slide scale 206 is disposed on an outer surface of one or more of the supports 254, 256 such that the amount of upward and downward movement can be monitored.

The upward and downward movement of each end of the cradle 312 is facilitated by a cradle adjustment device 334 coupled to the slides 328 for adjusting the position of the cradle 312 relative to the supports 254, 256. The cradle 312 adjustment device 334 includes a retainer 336 with an adjustment nut 338 disposed within the retainer 336 on each of the first 254 and second 256 supports. A vertical adjustment screw 342 is disposed in the first support 254 and another vertical adjustment screw 342 is disposed in the second support 256. Preferably, each of the vertical adjustment screws 342 are rotatably mounted to the adjustment slides 328 by any suitable means, such as through a roll pin 344. A vertical locking handle 208 is provided for each of the first 254 and second 256 supports wherein the vertical locking handles 208 engage the adjustment nuts 338 to retain the vertical adjustment screws 342 and cradle 312 in a desired position. As shown in FIG. 10, a counter 340 may be mounted to each of the vertical adjustment screws 342 to provide a visual indicator of the position of each end of the cradle 312. Alternatively, as shown in FIGS. 11 and 12, a dial 210 may also be disposed about each of the vertical adjustment screws 342 such that the position of each end of the cradle 312 can be monitored. As with the lateral adjustment screw 280, it is desired that the type of vertical adjustment screws 342 and the pitch of the threads of this screws 342 be calibrated to provide exact and logical measurements on the counter 340 or dial 210. As such, the user can easily determine the amount of adjustment for each end of the cradle 312. A grease fitting 348 is likewise provided for the vertical adjustment screws 342.

During a vertical adjustment operation of the cradle 312, the vertical locking handle 208 is released and the adjustment nuts 338 is either manually or electrically, through an electric motor (not shown), turned to rotate the screw 342 to move one end of the cradle 312 upwardly or downwardly relative to the first 354 and second 356 supports. For example, each end of the cradle 312 could move 2 inches in either direction independently from each other. Once the desired position is obtained, the vertical locking handle 208 is actuated to secure this new position of the end(s) of the cradle 312. The upward and downward adjustment of the cradle 312 imparts a vertical curve, in either direction, in the article as the article passes through the sweep unit assembly 232. The adjustment of the cradle 312, either independently or in combination with the lateral adjustment of the station 236, can also impart a compound curve, in any direction, in the article as the article passes through the assembly. It should be noted that typically the cradle 312 disposed in an initial station adjacent the roll former 28 remains flat (non-articulated) such that the sweep unit assembly 232 can easily mate with the end of the roll former 28.

As best shown in FIG. 11, the retainers 336 of the cradle adjustment devices 334 each have a common configuration that includes a common locking device. Even more preferably, the locking device includes a notch 212 on one end and an L-shaped hook 214 on an opposing end. The L-shaped hook 214 is designed and configured to cooperate with the notch 212. As such, when the stations 236 are abutting against each other, the L-shaped hook 214 of one station 236 engages the notch 212 of an adjacent station 236. This interengagement of the L-shaped hooks 214 and notches 212 securely couples the stations 236 together on the adjustment plate 238. As illustrated, the ends of the retainers 336 on the stations 236 at the end of the assembly 232 have the L-shaped hooks 214 and/or notches 212 removed for aesthetic purposes. Of course, the L-shaped hooks 214 and/or notches 212 could remain on the retainers 336 without affecting the functionality of the assembly 232. Also, the retainers 336 could have any suitable corresponding locking device so long as the stations 236 can be adequately held together. One benefit of a common locking device is that any desired number of stations 236 can be coupled together, such as 3, 5, 8, etc. As illustrated, 5 stations 236 are coupled together. Certainly the adjustment plate 246 and other components could be configured to accept any number of coupled stations 236.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that within the scope of the appended claims the invention may be practiced otherwise than as specifically described.

What is claimed is:

1. A sweep unit assembly for introducing a compound curve into an elongated article, said assembly comprising:

a base;

a series of stations defining a path for the article with said stations being movable relative to said base for introducing a first curve into said path and the article, each of said stations including a first support and a second support with a stabilizing bar interconnecting said first and second supports; and a cradle coupled to each of said stations between said first and second supports with each of said cradles independently movable relative to each of said stations in a direction transverse to said movement of said stations for introducing a second curve into said path and the article;

each of said stations further including a mount supporting said first and second supports and engaging said base such that each of said stations are movably secured to said base and remain easily accessible with said mount including a mounting plate pivotally bolted to said base about a fixed pivot point and coupled to each of said supports for adjusting said stations and said cradles through an arcuate path to impart various degrees of curvature into said path and the article.

2. An assembly as set forth in claim 1 wherein said mount further includes a bottom bar bolted to said supports and coupled to said mounting plate.

3. An assembly as set forth in claim 1 wherein said mounting plate includes an arcuate adjustment slot and an arcuate bearing slot.

4. An assembly as set forth in claim 3 further including a pivot bolt mounting said mounting plate to said base at said pivot point, an adjustment bolt mounting said mounting plate to said base through said adjustment slot, and a bearing member mounting said mounting plate to said base through said bearing slot.

5. An assembly as set forth in claim 1 wherein said mount is further defined as a bottom bar bolted to each of said supports and coupled to said base.

6. An assembly as set forth in claim 5 wherein said bottom bar is slidably secured to said base to move laterally relative to said base.

7. An assembly as set forth in claim 6 further including a station adjustment device mounted to one of said supports and coupled to said base to laterally adjust said station relative to said base.

8. An assembly as set forth in claim 1 further including a mounting plate adjustment device coupled to said mounting plate to adjust a position of said mounting plate and said station relative to said base.

9. An assembly as set forth in claim 8 wherein said mounting plate adjustment device includes a screw with calibrated threads and a counter to provide an accurate indication of an amount of adjustment.

10. An assembly as set forth in claim 1 further including a station adjustment device mounted to one of said supports and coupled to said mounting plate to laterally adjust a position of said station relative to said mounting plate.

11. An assembly as set forth in claim 10 wherein said station adjustment device includes a screw with calibrated threads and a counter to provide an accurate indication of an amount of adjustment.

12. An assembly as set forth in claim 1 wherein each mounting plate supports a pair of stations.

13. An assembly as set forth in claim 1 further including a T-shaped locking finger on one of said supports and a complementary shaped cavity on an adjacent support for receiving said T-shaped locking finger and interconnecting adjacent supports and stations.

14. An assembly as set forth in claim 13 wherein each mount supports a pair of stations.

15. An assembly as set forth in claim 14 further including a locking arm interconnecting each of said pairs of stations.

16. An assembly as set forth in claim 1 wherein said base includes an adjustment plate movably mounted to a fixed plate.

17. An assembly as set forth in claim 16 further including a base adjustment device coupled between said adjustment plate and said fixed plate to selectively move said adjustment plate relative to said fixed plate.

18. An assembly as set forth in claim 1 wherein said supports each include a top and a bottom with said stabilizing bar being mounted to said top and said mount being mounted to said bottom.

19. An assembly as set forth in claim 18 wherein each of said supports include an integral slot disposed between said top and bottom.

20. An assembly as set forth in claim 19 further including an adjustment slide mounted to each end of said cradle and slideably disposed within said slots.

21. An assembly as set forth in claim 20 further including a cradle adjustment device coupled to said slides for adjusting a position of said cradle relative to said supports.

22. An assembly as set forth in claim 21 wherein said cradle adjustment device includes a screw with calibrated threads and a counter to provide an accurate indication of an amount of adjustment.

23. An assembly as set forth in claim 1 wherein said cradle has a substantially U-shaped configuration for supporting a sweep block and at least partially encapsulating the sweep block.

24. An assembly as set forth in claim 1 wherein said cradle includes a pair of transverse pivot pins coupling said cradle to said supports and defining a cradle axis transverse to both of said movements of said stations and said cradles for automatically pivoting said cradle through a predetermined angle in response to the article passing through said stations and said cradles.

25. An assembly as set forth in claim 24 wherein said cradle includes hard stops defining said predetermined angle.

26. An assembly as set forth in claim 25 further including an adjustment slide mounted to each end of said cradle with each of said pivot pins extending through said slides.

27. An assembly as set forth in claim 26 wherein each of said slides includes an inner abutment surface and each end of said cradle includes exterior walls angled relative to said abutment surface by said predetermined angle such that said angled walls engage said abutment surface during said pivoting of said cradle to define said hard stops.

28. An assembly as set forth in claim 27 wherein said predetermined angle is from 2 degrees to 10 degrees.

29. An assembly as set forth in claim 28 wherein said predetermined angle is 6 degrees.

30. An assembly as set forth in claim 1 further including an initial station fixedly coupled to said base relative to said movable series of stations.

31. An assembly as set forth in claim 30 further including a platform coupled to said base adjacent said initial station for supporting an entry sweep block.

32. A sweep unit assembly for use with a sweep block for introducing a compound curve into an elongated article, said assembly comprising:

a base;

a series of stations defining a path for the article with said stations being movable relative to said base for introducing a first curve into said path and the article, each of said stations including a first support and a second support with a stabilizing bar interconnecting said first and second supports; and a cradle coupled to each of said stations between said first and second supports with each of said cradles independently movable relative to each of said stations in a direction transverse to said movement of said stations for introducing a second curve into said path and the article with said cradle having a substantially U-shaped configuration for supporting a sweep block and at least partially encapsulating the sweep block;

each of said stations further including a mount supporting said first and second supports and engaging said base such that each of said stations are movably secured to said base and remain easily accessible for adjusting said stations and said cradles to impart various degrees of curvature into said path and the article.

33. An assembly as set forth in claim 32 further including an adjustment slide mounted to each end of said cradle and slideably disposed within said supports.

34. An assembly as set forth in claim 33 further including a cradle adjustment device coupled to said slides for adjusting a position of said cradle relative to said supports.

35. An assembly as set forth in claim 34 wherein said cradle adjustment device includes a screw with calibrated threads and a counter to provide an accurate indication of an amount of adjustment.

36. An assembly as set forth in claim 32 wherein said cradle includes a pair of transverse pivot pins coupling said cradle to said supports and defining a cradle axis transverse to both of said movements of said stations and said cradles for automatically pivoting said cradle through a predetermined angle in response to the article passing through said stations and said cradles.

37. An assembly as set forth in claim 36 wherein said cradle includes hard stops defining said predetermined angle.

38. An assembly as set forth in claim 37 further including an adjustment slide mounted to each end of said cradle with each of said pivot pins extending through said slides.

39. An assembly as set forth in claim 38 wherein each of said slides includes an inner abutment surface and each end of said cradle includes exterior walls angled relative to said abutment surface by said predetermined angle such that said angled walls engage said abutment surface during said pivoting of said cradle to define said hard stops.

40. An assembly as set forth in claim 39 wherein said predetermined angle is from 2 degrees to 10 degrees.

41. An assembly as set forth in claim 40 wherein said predetermined angle is 6 degrees.

42. A sweep unit assembly for introducing a compound curve into an elongated article, said assembly comprising:

a base;

a series of stations defining a path for the article with said stations being movable relative to said base for introducing a first curve into said path and the article, each of said stations including a first support and a second support with a stabilizing bar interconnecting said first and second supports; and a cradle coupled to each of said stations between said first and second supports with each of said cradles independently movable relative to each of said stations in a direction transverse to said movement of said stations for introducing a second curve into said path and the article;

each of said stations further including a mount supporting said first and second supports and engaging said base such that each of said stations are movably secured to said base and remain easily accessible for adjusting said stations and said cradles to impart various degrees of curvature into said path and the article; and said cradle including a pair of transverse pivot pins coupling said cradle to said supports and defining a cradle axis transverse to both of said movements of said stations and said cradles for automatically pivoting said cradle through a predetermined angle in response to the article passing through said stations and said cradles.

43. An assembly as set forth in claim 42 wherein said cradle includes hard stops defining said predetermined angle.

44. An assembly as set forth in claim 41 further including an adjustment slide mounted to each end of said cradle with each of said pivot pins extending through said slides.

45. An assembly as set forth in claim 44 wherein each of said slides includes an inner abutment surface and each end of said cradle includes exterior walls angled relative to said abutment surface by said predetermined angle such that said angled walls engage said abutment surface during said pivoting of said cradle to define said hard stops.

46. An assembly as set forth in claim 45 wherein said predetermined angle is from 2 degrees to 10 degrees.

47. An assembly as set forth in claim 46 wherein said predetermined angle is 6 degrees.

* * * * *